United States Patent [19]

Smith et al.

[11] Patent Number: 4,919,013

[45] Date of Patent: Apr. 24, 1990

[54] PREFORMED ELEMENTS FOR A ROTARY DRILL BIT

[75] Inventors: Redd H. Smith; Jeffrey B. Lund, both of Salt Lake City, Utah

[73] Assignee: Eastman Christensen Company, Salt Lake City, Utah

[21] Appl. No.: 244,122

[22] Filed: Sep. 14, 1988

[51] Int. Cl.[5] ..... B21K 5/02; B22F 7/00

[52] U.S. Cl. ..... 76/108.2; 419/9; 419/37

[58] Field of Search ..... 76/108 A, 108 R, 101 R, 76/101 E, DIG. 11; 164/80; 419/6, 9, 5, 36, 37

[56] References Cited

U.S. PATENT DOCUMENTS

| | | | |
|---|---|---|---|
| 4,527,642 | 7/1985 | Knowltes | 175/329 |
| 4,563,329 | 1/1986 | Morishita | 419/9 |
| 4,608,225 | 8/1986 | Sakuramoto | 419/5 |
| 4,669,522 | 6/1987 | Griffin | 164/80 |

*Primary Examiner*—Roscoe V. Parker

*Attorney, Agent, or Firm*—Joseph A. Walkowski

[57] ABSTRACT

A rotary drill bit and process of fabrication in which internal fluid passages and watercourses of the bit are lined with a hard metal matrix material which renders the fluid passages more resistant to the erosive forces of the drilling fluid is provided. Also, elements such as lands for cutter element mountings, sockets, ridges, shoulders and the like on the exterior surface of the bit can be fabricated of a hard abrasion and erosion resistant material and incorporated into the bit body during fabrication. The process includes the steps of providing a hollow mold for molding at least a portion of the drill bit and positioning one or more flexible or moldable tubular elements which correspond to the internal watercourses in the mold. The elements are fabricated of a hard metal powdered material dispersed in a polymeric binder. A bit blank is then positioned at least partially within the mold and the mold packed with a metal matrix material which forms the body of the bit. The metal matrix material and the tubular elements are infiltrated with a binder in a furnace to form the bit, with the heat from the furnace burning out the polymeric binder in the tubular elements.

19 Claims, 2 Drawing Sheets

PREFORMED ELEMENTS FOR A ROTARY DRILL BIT

BACKGROUND OF THE INVENTION

This invention relates to rotary drill bits and methods of fabrication, and more particularly to drill bits having hard abrasion and erosion resistant elements, such as internal fluid passages, within and on the bit.

Typically, earth boring drill bits include an integral bit body which may be of steel or may be fabricated of a hard matrix material such as tungsten carbide. A plurality of diamond or other "superhard" material cutting elements are mounted along the exterior face of the bit body. Each diamond cutting element typically has a backing portion which is mounted in a recess in the exterior face of the bit body. Depending upon the design of the bit body and the type of diamonds used (i.e., either natural or synthetic), the cutters are either positioned in a mold prior to formation of the bit body or are secured to the bit body after fabrication.

The cutting elements are positioned along the leading edges of the bit body so that as the bit body is rotated in its intended direction of use, the cutting elements engage and drill the earth formation. In use, tremendous forces are exerted on the cutting elements, particularly in the forward to rear tangential direction as the bit rotates, and in the axial direction of the bit. Additional, the bit body and cutting elements are subjected to substantial abrasive and erosive forces.

Typically, the rotary bit also includes a fluid flow passage or internal watercourse through the interior of the bit which splits into a plurality of passages or courses which are directed to the exterior surface of the bit. These passages, and the exit ports from which fluid is ejected, are positioned about the exterior surface of the bit and high velocity drilling fluid is directed against or across the cutting elements to cool and clean them and to remove adhering cuttings therefrom. The fluid also aids in washing the cuttings from the earth formation upwardly to and through so-called junk slots in the bit to the surface. Again, the high velocity flow of drilling fluid exerts erosive forces on the internal fluid passages, and, in combination with the cuttings, exerts tremendous erosive forces on the exterior surfaces of the bit. The bit also experiences abrasion from contact with the formation being drilled.

Steel body bits have been used to drill certain earth formations because of their toughness and ductility properties. These properties render them resistant to cracking and failure due to the impact forces generated during drilling. However, steel is subject during drilling operations to rapid erosion from high velocity drilling fluids, and to abrasion from the formation. The internal watercourses formed within the steel bit are also subject to the erosive forces of the drilling fluid.

Composite bits formed of a hard metal or mixture of metals including tungsten carbide have been used because they are more resistant to the abrasive and erosive forces encountered by the bit. Such rotary bits are generally formed by packing a graphite mold with a metal powder such as tungsten carbide, steel, or mixture of metals and then infiltrating the powder with a molten copper alloy binder. A steel blank is positioned in the mold and becomes secured to the matrix as the bit cools after furnacing. Also present in the mold may be a mandrel or a plurality of rigid sand cast elements which, when removed after furnacing, leave behind the internal fluid passages or watercourses through the bit. After molding and furnacing of the bit, the end of the steel blank can be welded or otherwise secured to an upper threaded body portion of the bit.

It would be desirable in the manufacture of rotary bits for drilling earth formations to be able to place erosion resistant elements on the surface of the bit as well as rendering the internal fluid passages in the bit more resistant to erosion. Accordingly, there is still a need in the art for rotary drill bits having erosion resistant elements both on the exterior surfaces of the bit as well as the interior of the bit.

SUMMARY OF THE INVENTION

The present invention meets that need by providing a rotary drill bit and process of fabrication in which internal fluid passages and watercourses of the bit are lined with a hard metal matrix material which renders the fluid passages more resistant to the erosive forces of the drilling fluid. Also, elements such as lands for cutter element mountings, sockets, ridges, and the like on the exterior surface of the bit can be fabricated of a hard abrasion and erosion resistant material and incorporated into the bit body during fabrication.

In accordance with one aspect of the present invention, a process is provided for the production of a rotary drill bit matrix having internal watercourses therein for conveying fluid from the interior of the bit to the bit surface. The process includes the steps of providing a hollow mold for molding at least a portion of the drill bit. One or more flexible moldable tubular elements which correspond to the internal watercourses to be formed are positioned the within the mold. These tubular elements replace the prior art rigid sand cast elements. In a preferred embodiment of the invention, the elements are fabricated of a hard metal powder dispersed in a polymeric binder. To avoid flattening or kinking of the tubular elements, when flexing or shaping, the interiors of the elements are preferably filled with a removable displacement material such as sand.

A bit blank is then positioned at least partially within the mold and the mold packed with a powdered metal matrix material which forms the body of the bit. The matrix material may be a hard metal or mixture of metals for a composite bit or may be steel powder for a steel bit. The matrix material and the tubular elements are infiltrated with a binder in a furnace to form the bit, with the heat from the furnace burning out the polymeric binder in the tubular elements. After the bit has cooled and been removed from the mold, the removable material is removed from the elements to form the internal watercourses for the bit.

The polymeric binder used to form the tubular elements is preferably a thermoplastic or elastomeric resin which will provide some degree of moldability or flexibility to the elements. The binder may be any polymeric resin which will degrade and burn off during furnacing of the bit. It has been found that an elastomeric polyurethane resin is suitable for use in the present invention. The tubular elements may be either cast or extruded.

Because the tubular elements are relatively flexible or moldable, they may be directed and bent within the mold to better accommodate other elements on and within the bit as opposed to the prior art rigid sand cast elements. This provides for greater flexibility in the design of rotary drill bits. Moreover, the thickness of the tubular elements may be readily controlled during casting or extrusion of the thermoplastic binder to permit optimum design of the internal watercourses and the erosion resistance thereof.

The process of the present invention is also useful in the formation of erosion and abrasion resistant structural elements on the exterior surface of the bit. In a preferred form, the process includes the steps of providing a hollow mold for molding at least a portion of the drill bit and then positioning a composite element corresponding in size and shape to the element to be formed on the bit face in the mold. The composite element is preferably fabricated of a hard metal powder dispersed in a polymeric binder.

A bit blank is then positioned at least partially within the mold, and the mold is packed with a metal matrix material which forms the body of the bit. The matrix material and any composite elements are then infiltrated with a binder in a furnace to form the bit and the element on the bit face. The heat from the furnace burns out the polymeric binder in the element, and the remaining hard metal powder is infiltrated. After cooling, the bit is removed from the mold with the element in position on the face of the bit.

The element or elements which are formed may be, for example, a land for mounting a cutting element on the bit face or a ridge of hard metal material on the bit face. The element may also form a socket for mounting a cutting element on the bit face. All of these elements are erosion and abrasion resistant, having been formed from a hard metal.

Accordingly, it is an object of the present invention to provide a rotary drill bit and process of fabrication in which internal fluid passages and watercourses of the bit are lined with a hard metal matrix material which renders the fluid passages more resistant to the erosive forces of the drilling fluid. It is a further object of the invention to provide elements such as lands for cutter element mountings, sockets, ridges, and the like on the exterior surface of the bit which can be fabricated of a hard abrasion and erosion resistant material. These, and other objects and advantages of the present invention, will become apparent from the following detailed description, the accompanying drawings, and the appended claims.

DESCRIPTION OF THE PREFERRED EMBODIMENTS

Figure 1:
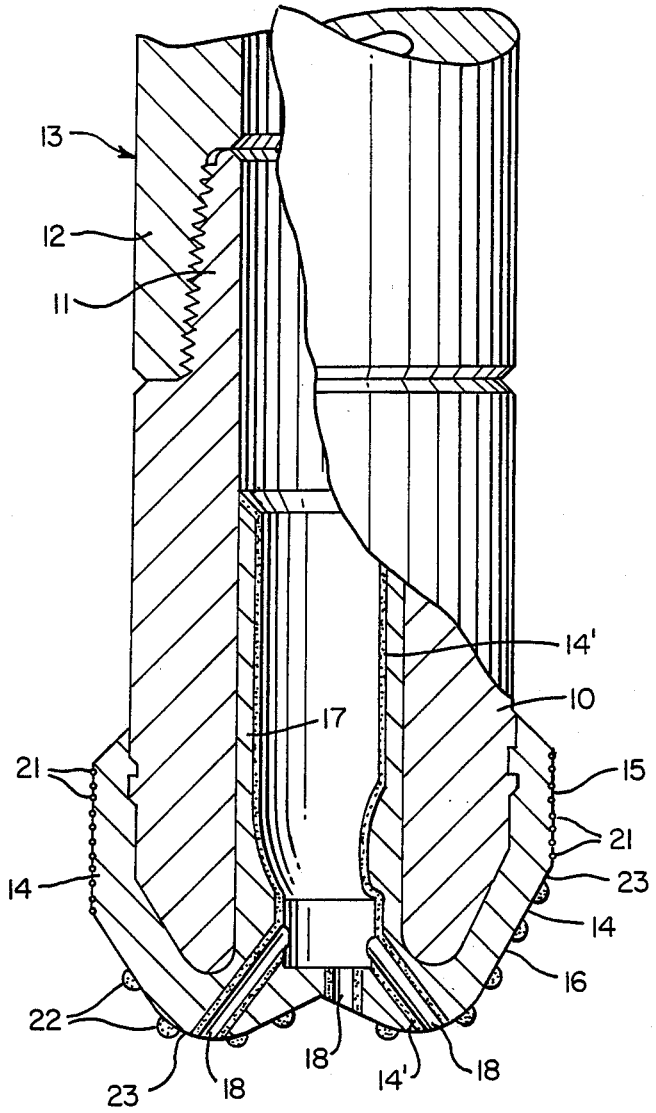
FIG. 1 is a view, partly in elevation and partly in section, of a rotary drill bit made in accordance with the present invention.

The invention is illustrated in the drawings with reference to a typical construction of a rotary earth boring bit. It will be recognized by those skilled in this art that the configuration of the cutting elements along the exterior face of the matrix may be varied depending upon the desired end use of the bit. Additionally, while the invention has been illustrated in conjunction with a full bore rotary matrix bit, it will be appreciated by those skilled in this art that the invention is also applicable to core head type bits for taking core samples of an earth formation.

Referring now to FIG. 1, a finished rotary drill bit made in accordance with the present invention is shown and includes a tubular steel blank having blades 10 extending from the lower end thereof welded to an upper pin 11 (weld line not shown) threadedly secured to a companion box 12 forming the lower end of the drill string 13. A matrix 14 of metal, such as metal bonded tungsten carbide, steel, or a composite mixture of metals has an upper gage section 15 which merges into a face portion 16 extending across the tubular blank. Matrix 14 is integral with an inner portion 17 disposed within and around the blank. Matrix 14 may also contain a displacement material as is taught by commonly assigned copending U.S. application Ser. No. 107,945 filed Oct. 13, 1987, now abandoned and entitled EARTH BORING DRILL BIT WITH MATRIX DISPLACING MATERIAL.

Hard metal material 14' forms the walls of fluid passages 18 providing abrasion and erosion resistant surfaces over which the drilling fluid passes. Preparation of the walls of fluid passages 18 is explained in greater detail below. Hard metal material 14' is preferably a hard metal or other hard material such as tungsten carbide, boron nitride, silicon nitride, or silicon carbide. The particle sizes of material 14' are chosen to provide a dense structure which is as hard or harder than the metal matrix material 14. Generally, the use of fine grain sizes provide a denser and harder coating structure.

Diamond cutting elements 21 may be optionally embedded in the stabilizer or gage section 15 of the bit to reduce wear on the latter section of the matrix. Cutting elements 22 are disposed in sockets 23 in matrix 14 and may be arranged in any desired conventional pattern which will be effective to perform the cutting action. Depending upon the type of diamonds utilized, sockets 23 may be preformed in the matrix during fabrication as explained in further detail below. If sockets 23 are preformed, then cutting elements 22 may be mounted therein, typically by brazing, in a separate operation after fabrication of the bit. On the other hand, if natural diamonds or polycrystalline synthetic diamonds which can withstand the processing temperatures encountered during fabrication are utilized, the diamonds may be positioned directly in the mold and secured thereto with a conventional adhesive prior to placement of the matrix material into the mold. This latter method eliminates the need for a separate step of mounting the cutting elements after molding of the bit.

The drilling fluid flows downwardly through drill string 13 into the inner portion 17 of the matrix bit crown 14, such fluid passing through exit ports 18 formed integrally in the matrix and having an erosion and abrasion resistant hard metal coating 14' thereon. The drilling fluid from the exit ports discharges from the face of the bit and against or across cutting elements 22. Exit ports may be circular, rectangular, or any other suitable shape in cross-section.

Figure 2:
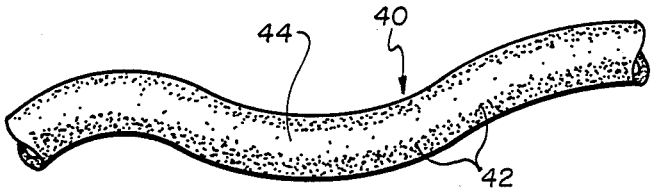
FIG. 2 is a fragmentary perspective view of a tubular element formed in accordance with the present invention.

The process of fabricating the drill bit of FIG. 1 will now be explained in greater detail. Referring now to FIG. 2, a flexible or moldable tubular element 40 is shown. The tubular element 40 comprises a hard metal powder 42 dispersed in a polymeric binder 44. For ease of fabrication, the hard metal matrix material is preferably in the form of a powder which can be readily mixed with the melted thermoplastic or uncured, liquid elastomeric binder. The hard metal material may be, for example, tungsten carbide, boron nitride, silicon nitride, or silicon carbide. The particle sizes of the hard metal material are preferably chosen to provide a dense structure which is as hard or harder than the bit matrix material which it protects. Generally, the use of fine grain sizes provides the dense, hard coating structure.

Polymeric binder 44 is preferably a thermoplastic or elastomeric resin which will provide some degree of moldability or flexibility to tubular element 40. The binder may be any resin which will degrade and burn off during materials in the mold. Suitable elastomeric resins include curable polyurethane resins which are commercially available in liquid form and which will cure at room temperature. An example of such a resin is Devcon Flexane 80 urethane resin available from Devcon Corporation, Danvers, Mass. Suitable thermoplastic resins include low density polyethylene which is widely available commercially.

Flexible or moldable element 40 may be fabricated, using conventional polymer casting, molding, or extrusion techniques to form a variety of sizes, thicknesses, and shapes. It has been found that suitable elements may be formed be formed by mixing together polymeric binder 44 and hard metal powder 42 in a ratio of binder to metal of between about 1:5 to about 1:20, by weight. Although higher or lower ratios may be used, mixtures having a high binder to metal ratio may not form as dense an abrasion and erosion resistant structure. Use of low binder to metal ratios may result in elements which have lesser degrees of moldability or flexibility during placement in the mold.

Figure 3:
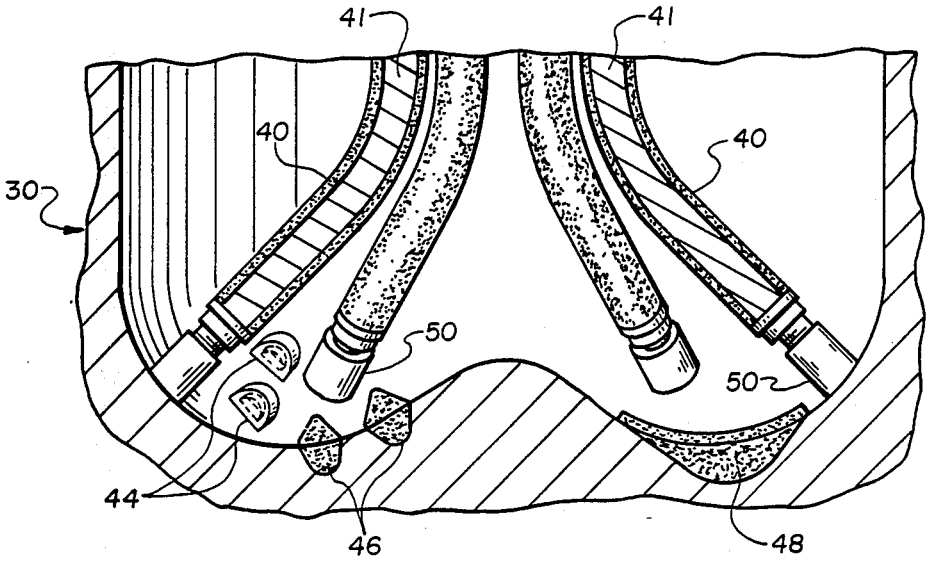
FIG. 3 is a side sectional view of a number of flexible tubular elements positioned within a mold.

Referring now to FIG. 3, a hollow mold 30 is provided in the configuration of the bit design. The mold 30 may be of any material, such as graphite, which will withstand the 1100 degrees C. and greater heat processing temperatures. If natural diamond cutting elements or synthetic polycrystalline diamonds which can withstand the processing temperatures are utilized, they are conventionally located on the interior surface of the mold 30 prior to packing the mold. The cutting elements 21 (not shown in FIG. 3) and 22 may be temporarily secured using conventional adhesives which vaporize during heat processing. During infiltration, the cutting elements will become secured in the matrix 14 which forms the body of the bit.

Alternatively, if other types of cutting elements are used, the mold may be shaped to produce preformed sockets 23 in matrix 14 or, composite elements may be positioned in the mold. These composite elements, in accordance with the present invention, are formed of a hard metal powder 42 dispersed in a polymeric binder 44. The composite elements are of a size and shape which corresponds to the size and shape of the desired finished element and may be positioned in mold 30 using adhesives or the like. Because polymer casting or molding techniques are used to form the composite elements, they may be easily fabricated to the exact size and shape required. After furnacing of the bit body, these composite elements will form hard, erosion and abrasion resistant elements on the bit surface to which the cutting elements may be secured after the bit body has been formed. The cutting elements may then be secured by any conventional means such as hard soldering or brazing. Additionally, the cutting elements may be mounted on studs which fit into the sockets, and the studs secured therein.

As shown in FIG. 3, tubular elements 40 are positioned within the mold in those areas where the internal fluid passages will be formed. Carbon displacement elements 50, which correspond in shape to nozzles which are secured after the furnacing of the bit, are secured at one end to the periphery of the mold and at an opposite end to tubular elements 40. After furnacing of the bit, the carbon displacement elements are removed, and nozzles affixed into the internal fluid passages.

Also shown in mold 30 are composite elements 44, 46 and 48 which, after furnacing of the bit, will form, respectively, sockets for receiving cutting elements, lands on which to mount cutting elements, and a ridge on the surface of the bit.

The flexible or moldable tubular elements 40 may be positioned so that there is clearance in the mold for other internal bit elements such as the bit blank, lands, shoulders, or ridges. To insure that the tubular elements maintain their internal diameters during placement and furnacing and do not kink or flatten out during furnacing elements 40 may be packed with said 41 or any other suitable material which can withstand the temperatures encountered during furnacing of the bit and which can be readily removed once the bit has been cooled.

After any desired composite structural elements have been positioned around the inner face of the mold, a tubular steel blank having blades thereon is partially lowered into the mold. Metal matrix material 14 is then added. The metal matrix material may be any suitable matrix material which can withstand the high processing temperatures encountered. Preferably, the matrix material is compatible with the binder. Depending upon the desired hardness of the finished bit, the metal matrix may be either steel powder or a harder material such as tungsten carbide, silicon carbide, silicon nitride, or boron nitride. Alternatively, the metal matrix material may be a mixture of materials and may include iron, steel, ferrous alloys, nickel, cobalt, manganese, chromium, vanadium, and metal alloys thereof, sand quartz, silica, ceramic materials, plastic-coated minerals, and mixtures thereof. The metal matrix material is preferably in the form of discrete particles, and may be is in the form of generally spherical particles. Particle sizes may vary greatly from about 400 mesh (approx. 0.001 inches) to about 0.25 inches in diameter. Particles smaller than about 400 mesh are not preferred because they tend to sinter to themselves and shrink during heat processing. Particles larger than about 0.25 inches are possible, with the upper limit on particle size being that size of particles which can be efficiently packed into mold 30.

A binder, preferably in the form of pellets or other small particles, as well as flux (not shown) is then poured into and fills mold 30. The amount of binder utilized should be calculated so that there is a slight excess of binder to completely fill all of the interstices between particles of filler material. The binder is preferably a copper-based alloy as is conventional in this art. The mold 30 is then placed in a furnace which is heated to above the melting point of the binder, typically, about 1100 degrees C. At this temperature, the polymeric binder in the tubular elements 40 and any other composite elements positioned in the mold degrades and vaporizes, with the vapor being vented from the mold.

The molten binder passes through and completely infiltrates metal matrix material 14, tubular elements 40, and any other composite elements in the mold. The materials are fused into a solid body which is bonded to the steel blank. The hard metal materials which were a part of the tubular elements now form the internal fluid passages for the bit. After cooling, the bit body is removed from the mold. Any sand or other removable material is then removed from the internal fluid passages. The steel blank is then welded or otherwise secured to an upper body or shank such as a companion pin which is then threaded to box 12 of the lowermost drill collar at the end of drill string 13. Cutting elements 21 and 22, if not previously secured to the bit in the mold, may be mounted at this time.

In order that the invention may be more readily understood, reference is made to the following example, which is intended to illustrate the invention, but is not to be taken as limiting the scope thereof.

EXAMPLE

A flexible tubular element suitable for use as an internal watercourse was fabricated using an elastomeric polyurethane resin and powdered tungsten carbide. The resin was Devon Flexane 80 available from Devon Corporation of Danvers, Mass. The urethane was formulated to have a durometer hardness of 37. A ratio of 12.5 parts tungsten carbide to 1 part resin, by weight, was used. The sample had a density of 11.4 gm/cm and contained 32% tungsten carbide by volume.

The resin and powder were thoroughly mixed and then poured into an acrylic mold. The tubular element was cured at room temperature for 24 hours. The element was approximately 12 inches in length, with an internal diameter of ⅝" and an outer diameter of 1". The finished element was very flexible. A portion of the element was furnaced and infiltrated with a copper-alloy binder. Some minor porosity was observed on the inner diameter but did not appear to extend through the sample.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A process for the production of a rotary drill bit having abrasion and erosion resistant internal watercourses therein for conveying fluid from the interior of the bit to the surface thereof, comprising the steps of:

(a) providing a hollow mold for molding at least a portion of the drill bit;

(b) providing one or more flexible or moldable tubular elements corresponding to said internal watercourses to be formed and positioning said elements within said mold, said elements being fabricated of a hard metal powder dispersed in a polymeric binder;

(c) positioning a bit blank at least partially within said mold;

(d) packing said mold with a powdered matrix material; and (e) infiltrating said powdered matrix material and said tubular elements with a binder in a furnace to form said bit, the heat from said furnace burning out said polymeric binder in said elements.

2. The process of claim 1 in which said elements are filled with a removable displacement material which is removed from said elements after furnacing of said bit to form said internal watercourses.

3. The process of claim 1 in which said hard metal powder is tungsten carbide.

4. The process of claim 1 in which said polymeric binder is an elastomeric resin.

5. The process of claim 4 in which said elastomeric resin is a polyurethane.

6. The process of claim 1 in which said polymeric binder is a thermoplastic resin.

7. The process of claim 6 in which said thermoplastic resin is a low density polyethylene.

8. The process of claim 1 in which said matrix material is a hard metal selected from the group consisting of tungsten carbide, silicon carbide, boron nitride, and silicon nitride.

9. The process of claim 1 in which said matrix material is steel powder.

10. A product made by the process of claim 1.

11. A process for the formation of a hard abrasion and erosion resistant three-dimensional metal element on and integral with the face of a rotary drill bit comprising the steps of:

(a) providing a hollow mold for molding at least a portion of the drill bit;

(b) providing a composite element corresponding in size and shape to the three-dimensional element to be formed on and integral with said bit face and positioning said composite element in said mold, said composite element being fabricated of a hard metal material in a polymeric binder;

(c) positioning a bit blank at least partially within said mold;

(d) packing said mold with a powdered matrix material;

(e) infiltrating said powdered matrix material and said composite element with a binder in a furnace to integrally form said bit and said element on said bit face, the heat from said furnace burning out said polymeric binder in said composite element; and (f) removing said bit from said mold with said integral three-dimensional element in position on the face of said bit.

12. The process of claim 11 in which said integral three-dimensional element is a land for mounting a cutting element on said bit face.

13. The process of claim 11 in which said integral three-dimensional element is a ridge of hard metal material on said bit face.

14. The process of claim 11 in which said integral three-dimensional element is a socket for mounting a cutting element on said bit face.

15. The process of claim 11 in which said polymeric binder is an elastomeric resin.

16. The process of claim 13 in which said elastomeric resin is a polyurethane.

17. The process of claim 11 in which said polymeric binder is a thermoplastic resin.

18. The process of claim 17 in which said thermoplastic resin is a low density polyethylene.

19. The process of claim 1 in which said hard metal is selected from the group consisting of tungsten carbide, silicon carbide, boron nitride, and silicon nitride.

* * * * *